United States Patent [19]

Fujii et al.

[11] Patent Number: 5,032,852

[45] Date of Patent: Jul. 16, 1991

[54] IMAGE FORMING APPARATUS

[75] Inventors: Haruo Fujii; Tatsuya Kobayashi, both of Yokohama; Junichi Kato, Sagamihara, all of Japan

[73] Assignee: Canon Kabushiki Kaisha, Tokyo, Japan

[21] Appl. No.: 469,162

[22] Filed: Jan. 24, 1990

[30] Foreign Application Priority Data

Jan. 27, 1989 [JP] Japan ..... 1-16186

[51] Int. Cl.[5] ..... G03G 15/01

[52] U.S. Cl. ..... 346/157; 355/326

[58] Field of Search ..... 346/157; 355/245, 326

[56] References Cited

U.S. PATENT DOCUMENTS 4,292,387 1/1990 Kanbe et al. .

4,416,533 11/1983 Tokunaga et al. ..... 355/4

4,814,797 3/1989 Haneda et al. ..... 346/157

4,841,332 6/1989 Haneda et al. ..... 355/251

4,937,630 6/1990 Yoshikawa et al. ..... 355/245 X

*Primary Examiner*—George H. Miller, Jr.

*Attorney, Agent, or Firm*—Fitzpatrick, Cella, Harper & Scinto

[57] ABSTRACT

The present invention provides an image forming apparatus comprising a first developing device for developing a first latent image to form a first toner image, a second developing device for acting on an image bearing member on which the first toner is formed to develop a second latent image thereby creating a second toner image, and an antioxidant material layer provided on a surface of a developing sleeve of the second developing device.

7 Claims, 3 Drawing Sheets

IMAGE FORMING APPARATUS

BACKGROUND OF THE INVENTION

1. Field of the Invention

The present invention relates to an image forming apparatus capable of forming a multi-color image by using a plurality of developing devices.

2. Related Background Art

Nowadays, electrophotographic printers have been widely used as an output equipment for a computer, facsimile, CAD and the like. Those printers have been developed to provide a multi-color image. As an example, an electrophotographic printer for forming a two-color image will be explained with reference to FIG. 1. As shown in FIG. 1, after a surface of an electrophotographic photosensitive drum 1 rotating in a direction shown by the arrow, has been uniformly charged by means of a first charger 2, a first electrostatic latent image is formed on the surface of the drum 1 by exposing the drum surface by means of a laser beam 3' modulated in response to first image information. The latent image is then developed with reversal development in a first developing station D1 by means of a first developing device 6 to form a first color toner image. Incidentally, the toner i.e., developer T1 is carried and conveyed by a sleeve 5.

Then, after the drum surface has been charged again with the same charging polarity as the first charger 2, by means of a second charger 7, a second electrostatic latent image is formed on the drum surface by exposing the drum surface by means of a laser beam 8' modulated in response to second image information. The second electrostatic latent image is developed with reversal development in a second developing station D2, by means of a second developing device 10, to form a second color toner image. The charging polarity of the first color toner, used in the first developing device 6, is the same as that of the second color toner, used in the second developing device 10.

The first and second color toner images on the photosensitive drum 1 are transferred altogether onto a transfer sheet 17 by means of a transfer charger 18. The transferred two-color image is fixed to the transfer sheet 17 by means of a fixing device 19; whereas, after transferring operation, the surface of the photosensitive drum 1 is cleaned by a cleaning device 20.

Incidentally, the laser beams 3' and 8' are emitted, respectively, from exposing devices 3 and 8, each comprising a semi-conductor laser and a rotary mirror for deflecting the laser beam emitted from the semi-conductor laser. The photosensitive drum is scanned by such laser beams with a raster pattern. In this example wherein the reversal development is adopted, the laser beam 3' and 8' expose areas to be visualized by the toner. In this example, the first charger and the exposing device 3 constitute a first latent image forming means 4, whereas the second charger 7 and the exposing device 8 constitute a second latent image forming means 9.

The second developing device 13 acts on the drum surface on which the first color toner image has been formed, thereby developing the second latent image. Accordingly, in the second developing station D2, it is so designed that the thickness of a developer layer formed on a sleeve 11 of the second developing device 13 (i.e., a developer bearing member for carrying the developer and conveying it to the developing station) is smaller than a minimum distance between the photosensitive drum 1 and the sleeve 11 at the second developing station, whereby the developer carried by the sleeve 11 is prevented from slidingly contacting the first color toner image. Thus, preventing the scraping of the image from the drum.

In order to improve the developing efficiency of the above-mentioned second developing device 10 of a so-called non-contacting type, the alternate bias voltage may be applied to the sleeve, as described in the U.S. Pat. No. 4,292,387. In this case, the developer is moved reciprocably between the photosensitive drum and the sleeve to thereby apply the developer of the amount corresponding to the potential of the latent image onto the drum eventually.

In this case, the alternating bias voltage applied to the sleeve 11 acts to press the first color toner image against the drum 1 in one phase, but to separate the first color toner image from the drum 1 in the other phase. In order to prevent that the first color toner image is separated from the drum 1 and is entered into the second developing device 10 in the other phase, it is preferable that the peak-to-peak value of the alternating bias voltage (absolute value between the maximum value and the minimum value alternately obtained repeatedly) is smaller.

However, if the peak-to-peak value of the alternating bias voltage is small, it is apt to generate a fine powder layer, which is difficult to be flown toward the photosensitive drum, on the surface of the sleeve, thus making the formation of the latent image difficult. The reason is assumed as follows.

That is to say, in the conventional apparatuses, the developing sleeve is normally constituted by a cylinder made of non-magnetic metal such as stainless steel, aluminum or the like. Such material normally forms, on its outer surface, a high resistance oxidized film when it is exposed to the air, and, when the fine particles having large charge and included in the developer contacts with the oxidized film, the fine particles are strongly attracted to the oxidized film due to the charges thereof, thus forming the fine powder layer on the film. Consequently, the toner applied onto the fine powder layer is not frictionally charged adequately between the toner and the sleeve, with the result that the frictional charge of the toner will be insufficient, thereby lowering the flying force of the toner toward the photosensitive drum. For this reason, it is guessed that the density of the image is reduced. Accordingly, in order to compensate such insufficiency, in the conventional apparatuses, it was necessary to increase the peak-to-peak value Vpp of the alternate voltage applied to the sleeve.

However, in the conventional apparatus, since the peak-to-peak value Vpp of the alternating voltage was large, there arose the problems that the first color toner image formed on the photosensitive drum was disturbed and that the toner separated from the first color toner image was attracted into the second developing device to mix with the second color toner.

SUMMARY OF THE INVENTION

An object of the present invention is to solve the above problems.

Another object of the present invention is to provide an image forming apparatus which can form a distinct second color toner image having adequate density without disturbing a first color toner image, by preventing the formation of overcharged fine powder layer on a developer bearing member to permit adequate frictional charging of the developer between it and the developer bearing member.

A further object of the present invention is to provide an image forming apparatus which can reduce a peak-to-peak value of alternating bias voltage applied to a developer bearing member of a second developing device using second color toner.

The other objects and advantages of the present invention will be apparent from the following description in connection with the accompanying drawings.

DESCRIPTION OF THE PREFERRED EMBODIMENTS

Figure 1:
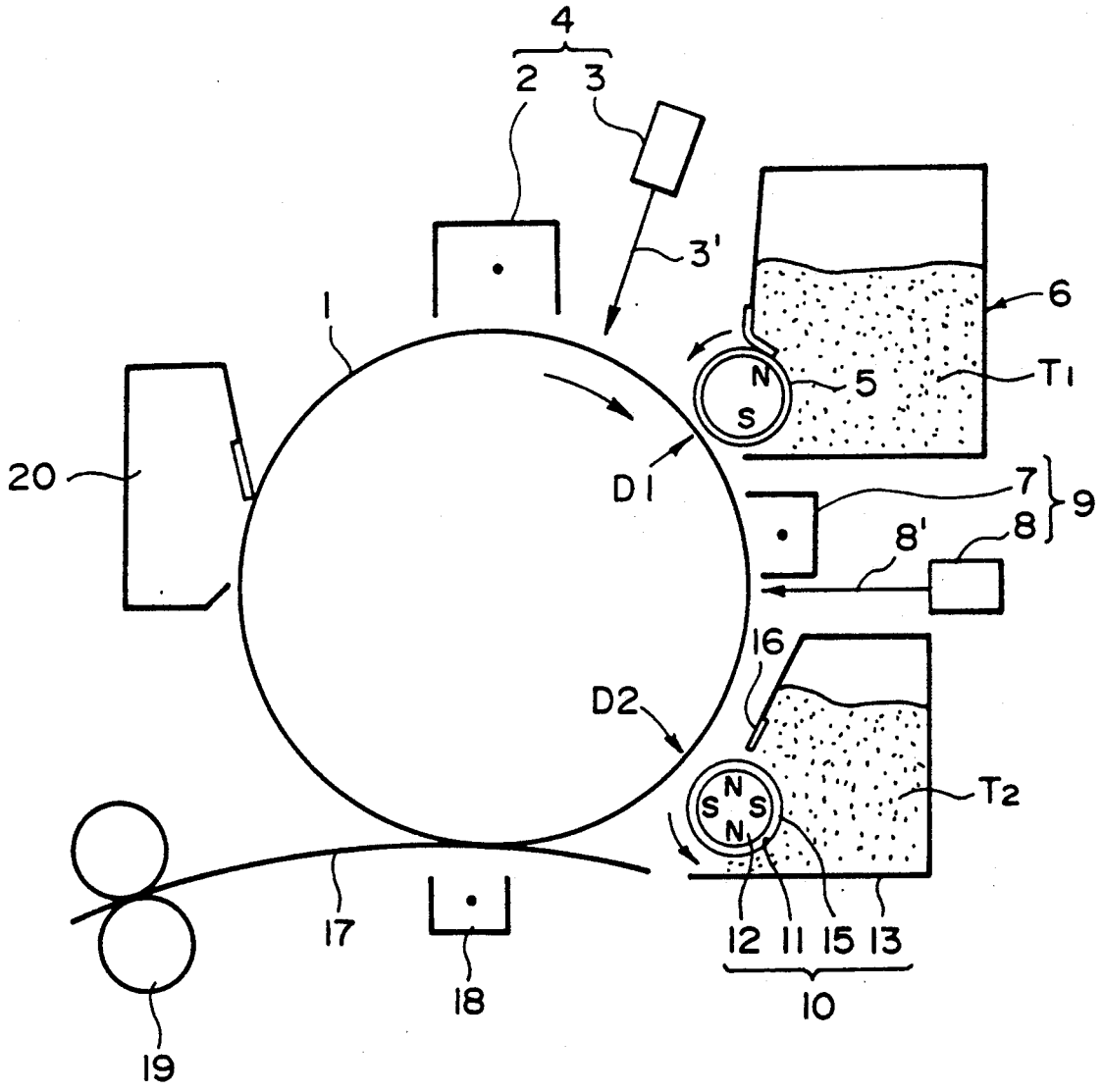
FIG. 1 is a schematic sectional view of an image forming apparatus to which the present invention can be applied.

FIG. 1 shows an image forming apparatus to which the present invention is applicable, and an operation or function of this image forming apparatus is as mentioned hereinbefore.

In this image forming apparatus, the first developing device 6 may be a conventional developing device of reversal development type. The second developing device 10 are constituted as shown in FIG. 2.

Figure 2:
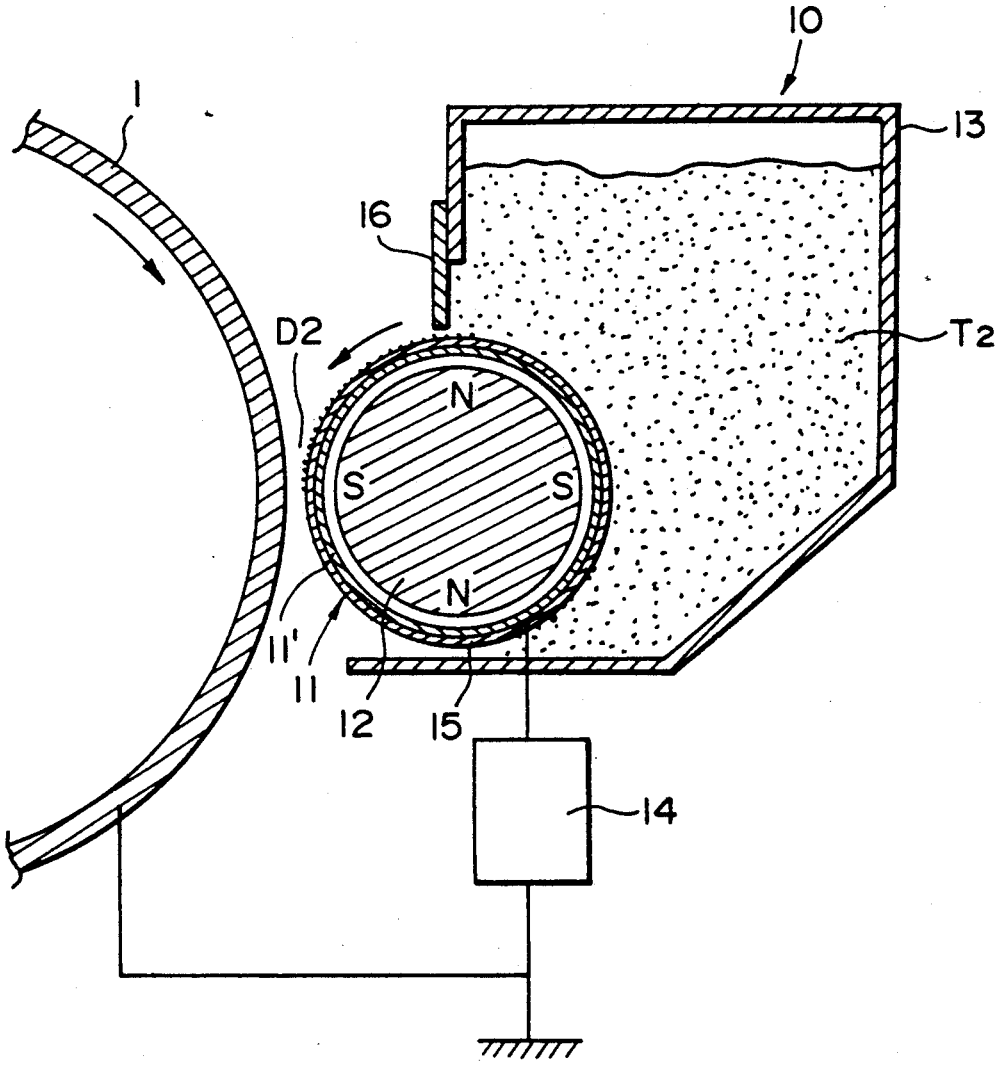
FIG. 2 is a cross-sectional view of a second developing device of an image forming apparatus according to a preferred embodiment of the present invention.

In FIG. 2, the second developing device 10 comprises a developing sleeve 11 arranged in the vicinity of the photosensitive drum 1 and rotated in a direction shown by the arrow to carry developer. The developing drum conveys developer to the second developing station D2, and a magnet 12 fixedly mounted within the developing sleeve 11. A developer accommodating container 13 contains the developer T2 to be supplied to the developing sleeve 11, and an electric power source 14 applies alternating bias voltage obtained by overlapping the direct voltages to the developing sleeve 11. An outer surface of the developing sleeve 11 is coated by a layer 15 of antioxidant material.

As the developer T2, one-component magnetic developer, i.e., developer having the magnetic toner as a main component and not including carrier particles was used. The thickness of the developer layer formed on the sleeve 11 is so regulated that it is smaller than the minimum distance between the sleeve 11 and the drum 1 at the developing station D2. As means for regulating the thickness of the developer layer, a magnetic blade 16 made of iron and the like and arranged in confronting relation to the sleeve 11 with a small gap in the magnetic field generated by one magnetic pole (N pole in FIG. 2) of the magnet 12 was used. The thickness of the developer layer carried and conveyed by the sleeve 11 is regulated to be smaller than a distance between the blade 16 and the sleeve 11, by the concentrated magnetic field originated between the blade and the N pole of the magnet 12.

The developer, i.e., magnetic toner is charged to have the same charging polarity as that of the toner in the first developer T1 by frictionally contacting with the sleeve 11. That is to say, the magnetic toner is charged to have the same charging polarity of the second charger 7 and accordingly of the first charger 2.

By using the image forming apparatus having the above-mentioned arrangement, the following test was carried out.

The photosensitive drum 1 was made of organic photoconductive (OPC) material and the antioxidant layer 15 coating the aluminum sleeve body 11' was made of material obtained by dispersing carbon in the phenol resin and having a resistance value of $10^{-3}$– $10^{5}\Omega\cdot$cm (preferably, $10^{-3}$–$10^{3}\Omega\cdot$cm), and the thickness of the layer was 0.1 μm -10 μm. Such sleeve itself may be a sleeve described in the U.S. Ser. No. 341,352. As the toner, one-component magnetic toner for a laser printer LBP-8II manufactured by Canon Co. (Japan) was used.

Under these conditions, the photosensitive drum 1 was rotated at a peripheral speed of 88 mm per second, and the surface of the photosensitive drum 1 was charged to have a surface potential $Vd_1$ of −600 V by means of the first charger 2. Thereafter, the photosensitive drum was exposed by the first laser beam 3' to form the first latent image including the bright portions having the potential $V\ l_1$ of −100 V, and the first latent image was developed with the reversal development by the negatively charged toner in the first developing device 6 to form the first toner image on the photosensitive drum. Then, the surface potential $Vd_2$ of the surface area (of the drum 1) on which the first toner image is not formed was charged to −700 V by means of the second charger 7, and the surface potential $V_T$ of the first toner image was charged to −650 V (absolute value thereof is slightly smaller than that of the potential $Vd_2$). Thereafter, the photosensitive drum was exposed by the second laser beam to form the second latent image including the bright portion having the potential $Vl_2$ of −100 V. This second latent image was developed by the negatively charged toner in the second developing device. By using the alternating voltage (to be applied to the developing sleeve) obtained by overlapping the direct voltage components of −550 V which is a value included between the potential $V_T$ of the first toner image and the potential $V\ l_2$ of the bright portion of the second latent image (i.e., potential of the area to be visualized by the second toner) and having the peak-to-peak value Vpp of 1300 V and frequency of 1600 Hz, a distinct second toner image having adequate density was obtained without disturbing the first toner image and preventing the flow-in of the first toner to the second developing device.

In order to obtain the toner image having the same density as that obtained by the above test by using the conventional apparatus wherein the developing sleeve is not coated by the antioxidant layer, the peak-to-peak value of the alternating voltage must be 1600 V. Accordingly, by coating the developing sleeve by the antioxidant layer, it was ascertained that it was possible to reduce the peak-to-peak value of the alternating voltage, to obtain the distinct image without disturbing the first toner image and to considerably reduce the flow-in of the first toner to the second developing device 10.

Further, as the antioxidant layer 15 for coating the developing sleeve 11, when the material obtained by mixing ketchen black of 4%, graphite of 30% and low-molecular monomer of urethane with ethylene acrylate and diluting with a solution such as acetone was coated on the developing sleeve body 11' and then was hardened to form the antioxidant layer, the same advantage could be obtained in the same test as mentioned above.

Further, when ceramic coating agent such as G401 (trade mark) sold by Nichihan Kenkyusho Co., Ltd. (Japan) was coated on the developing sleeve body 11' and was hardened to obtain the antioxidant layer 15, the same advantage could be obtained. In addition, the antioxidant layer 15 may be obtained by deposing gold or platinum (which is non-oxidized metal) with a thin film on the developing sleeve body.

Incidentally, the alternating bias voltage applied to the developing sleeve 11 of the second developing device 10 is a voltage capable of alternately generating a first phase wherein the electrical field for applying the toner to a force directing toward the photosensitive drum 1 is created, and a second phase wherein the electrical field for applying the toner to a force directing toward the sleeve 11 is created. However, in order to prevent the separation of the toner in the first toner image from the drum 1 and thus to prevent the flying of such toner toward the sleeve 11, it is preferable to appropriately set the voltage applied to the sleeve 11 in the second phase to a proper value. And, the alternating voltage ($Vpp=|Vmax-Vmin|$) alternately presenting the maximum value Vmax (V) and the minimum value Vmin (V) is applied to the sleeve 11. If the first toner is positively charged (plus charging polarity), the minimum value Vmin creates the electrical field for applying the maximum force to the toner to bias the toner from the first toner image having the potential $V_T$(plus charging polarity) toward the sleeve 11. On the other hand, if the first toner is negatively charged (minus charging polarity), the maximum value Vmax creates the electrical field for applying the maximum force to the toner to bias the toner from the first toner image having the potential (minus charging polarity) toward the sleeve 11.

Further, as described in the U.S. Ser. No. 161,029, in order to prevent the disturbance or destruction of the first toner image and the flow-in of the first toner into the second developing device, it is preferable that, when the first toner is charged positively, the minimum value Vmin (V) meets the following equation (1), and when the first toner is charged negatively, the maximum value Vmax (V) meets the following equation (2):

$$|V\text{min}-V_T|/d \leqq 2.25 \quad (1)$$

$$|V\text{max}-V_T|/d \leqq 2.25 \quad (2)$$

Here, $V_T$ is the surface potential (V) of the first toner image charged by the second charger 7, and d is the minimum distance (μm) between the photosensitive drum 1 and the sleeve 11 at the second developing station D2.

The condition stipulated by the above equations (1) and (2) is similarly preferable in a further embodiment described hereinbelow.

Figure 3:
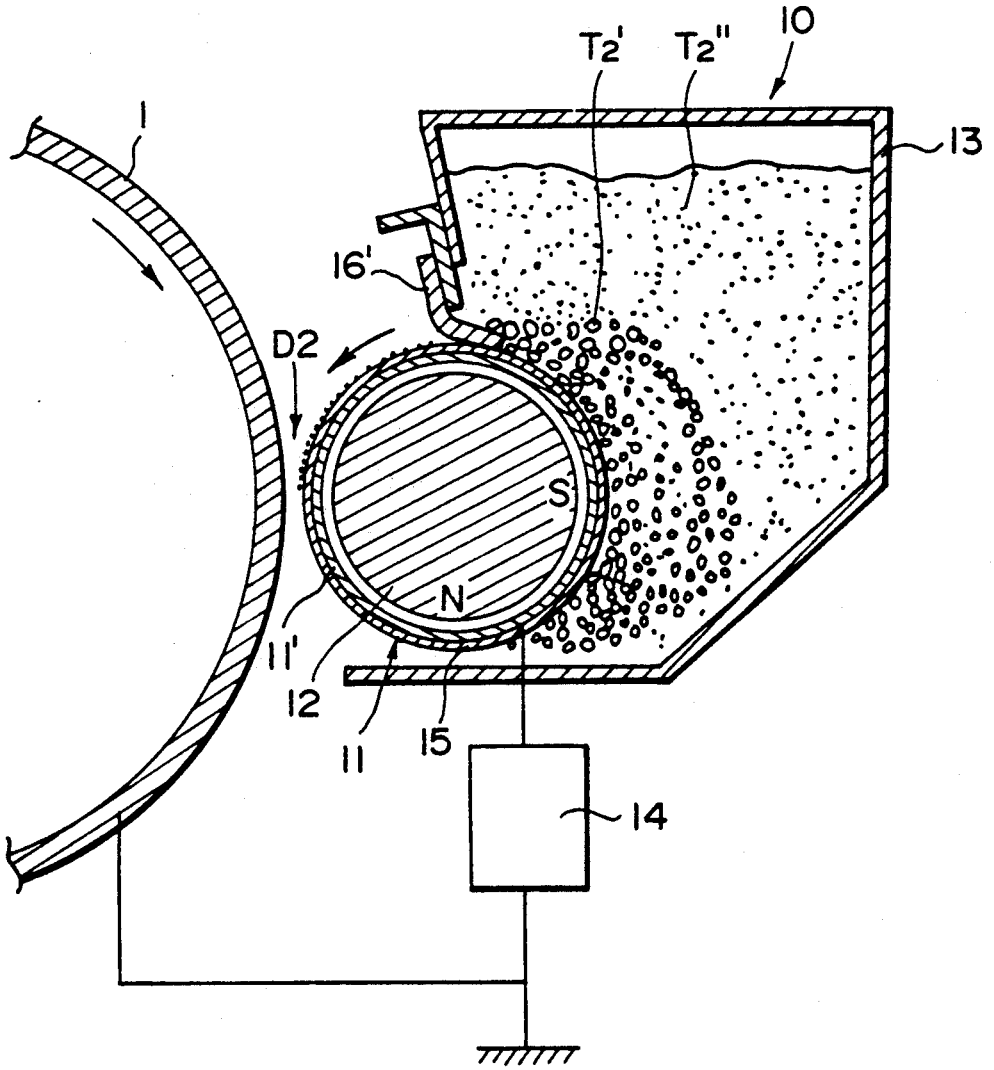
FIG. 3 is a cross-sectional view of the second developing device according to another embodiment of the present invention.

In an apparatus shown in FIG. 3, as the toner contained in the container 13, two-component toner obtained by mixing magnetic carrier $T_2'$ having iron powder as a main component and non-magnetic toner $T_2''$ constituting colored charge particles is used, and a carier flow-out preventing means 16' such as an elastic blade is abutted against the developing sleeve 11. Further, the surface of the developing sleeve 11 is coated by the antioxidant layer 15 as in the previous embodiment.

Also with the arrangement as mentioned above, when the same test as described in the previous embodiment was carried out, it was ascertained that the same advantage as that in the previous embodiment was obtained.

Incidentally, in the apparatus shown in FIG. 3, the magnetic carrier is prevented from flowing out of the container 13 by the magnetic holding force due to the electrical field created by the magnetic pole (S pole in the illustrated embodiment) of the fixed magnet 12 and the mechanical holding force generated by the elastic blade 16' such as a rubber abutted against the sleeve 11 downstream of the S pole of the magnet in the rotational direction of the sleeve, and the non-magnetic toner layer (substantially not including the magnetic carrier), the thickness of which is regulated to be small by the blade 16', is conveyed to the developing station D2. The toner is charged by frictionally contacting with the carrier and the sleeve. Incidentally, in the apparatus shown in FIG. 3, in place of the two-component toner including the carrier, non-magnetic one-component developer (non-magnetic toner) may be used. Further, in FIG. 3, in place of the blade 16', a magnetic member may be arranged in confronting relation to the sleeve 11 with a small gap and downstream of the S pole of the magnet in the rotational direction of the sleeve, whereby the carrier is prevented from flowing out of the container by the magnetic field created between the magnetic member and the S pole of the magnet.

Incidentally, the antioxidant material layer as mentioned above means not only a layer of material which is never oxidized even by trying to oxidize it intentionally by firing, but also a layer of material which is difficult to form a thin oxidized film thereon in comparison with aluminum or stainless steel.

Further, in the illustrated embodiment, while the alternate bias voltage was applied to the sleeve 11, the present invention can be applied to an apparatus wherein direct bias voltage a magnitude of which is not varied with time is applied to the sleeve. In this case, the direct bias voltage is set to have a value between the potential of the first toner image charged by the second charger 7 and the potential of the bright portion of the second latent image, thereby preventing the flying of the second toner toward the first toner image and permitting the flying of the second toner onto the bright portion of the second latent image. According to the present invention, since the second toner is adequately charged by frictionally contacting with the sleeve 11, the density of the second toner image can be improved. Further, since the level of the direct bias voltage to be applied to the sleeve 11 can be set to more approach to the potential of the bright portion of the second latent image, it is possible to prevent the flow-in or mixing of the second toner to the first toner image more positively.

Incidentally, the direct voltage component of the above-mentioned alternate bias voltage also contributes to prevent the flow-in or mixing of the second toner to the first toner image.

Further, in the illustrated embodiments, while an example that the antioxidant layer 15 is coated on the sleeve body 11' was explained, such sleeve body 11' may not be used and the sleeve 11 may be formed by molding the above-mentioned antioxidant material itself. In this case, the whole sleeve is constituted by the antioxidant material.

Further, in the illustrated embodiments, while the two-color image forming apparatus was explained, the present invention can be applied to an image forming apparatus which forms an image with toner having three or more different colors. In this case, it is effective that the present invention is applied to a developing device positioned downstream of the second developing device in the rotational direction of the photosensitive drum. However, the present invention can be applied to at least one of the developing devices arranged downstream of the first developing device.

In addition, the developing sleeve 5 of the first developing device may be coated by the antioxidant material layer as mentioned above and the alternate bias voltage or the direct bias voltage may be applied to the sleeve of the first developing device.

Further, when three or more developing devices are used and the non-magnetic toner is used in each developing device, by coating the surface of the developing sleeve of each developing device by the antioxidant layer 15, the features of the developing devices are equalized, with the result that, when the colored image is formed by using these developing devices including, for example, cyan toner, magenta toner and yellow toner, respectively, the balanced color image can be obtained.

What is claimed is:

1. An image forming apparatus comprising:

an endless moving image bearing member;

latent image forming means for forming first and second electrostatic latent images on said image bearing member;

a first developing means for developing said first electrostatic latent image to form a first toner image at a first developing station;

a second developing means for acting on said image bearing member on which said first toner image is formed in a second developing station, to develop said second electrostatic latent image thereby forming a second toner image, said second developing means including a developer bearing member for carrying the developer and conveying the same to said second developing station, and said developer bearing member begin provided with a surface layer of antioxidant material; and an electric power source for applying an alternating bias voltage to said developer bearing member of said second developing means, wherein said second developing means includes a developer layer regulating member for forming a developer layer having a thickness smaller than a minimum distance between said image bearing member and said developer bearing member, on said developer bearing member at said second developing station, wherein said first developing means develops said first electrostatic latent image with reversal development, and said second developing means develops said second electrostatic latent image with reversal development by using second toner charged to have the same charging polarity as that of first toner used in said first developing means, and wherein, when a maximum value of said alternating bias voltage is Vmax (Volts), a minimum value thereof is Vmin (Volts), potential of said first toner image opposed to said second developing means is $V_T$ and the minimum distance between said image bearing member and said developer bearing member at said second developing station is d ($\mu$m), if the charging polarity of said first toner is positive, said minimum value Vmin (Volts) meets the following equation:

$$|V_{min} - V_T|/d \leqq 2.25.$$

2. An image forming apparatus comprising:

an endless moving image bearing member;

latent image forming means for forming first and second electrostatic latent images on said image bearing member;

a first developing means for developing said first electrostatic latent image to form a first toner image at a first developing station;

a second developing means for acting on said image bearing member on which said first toner image is formed in a second developing station, to develop said second electrostatic latent image thereby forming a second toner image, said second developing means including a developer bearing member for carrying the developer and conveying the same to said second developing station, and said developer bearing member begin provided with a surface layer of antioxidant material; and an electric power source for applying an alternating bias voltage to said developer bearing member of said second developing means, wherein said second developing means includes a developer layer regulating member for forming a developer layer having a thickness smaller than a minimum distance between said image bearing member and said developer bearing member, on said developer bearing member at said second developing station, wherein said first developing means develops said first electrostatic latent image with reversal development, and said second developing means develops said second electrostatic latent image with reversal development by using second toner charged to have the same charging polarity as that of first toner used in said first developing means, and wherein, when a maximum value of said alternating bias voltage is Vmax (Volts), a minimum value thereof is Vmin (Volts), potential of said first toner image opposed to said second developing means is $V_T$ and the minimum distance between said image bearing member and said developer bearing member at said second developing station is d ($\mu$m), if the charging polarity of said first toner is negative, said maximum value Vmax (Volts) meets the following equation:

$$|V_{max} - V_T|/d \leqq 2.25.$$

3. An image forming apparatus according to claim 1 or, wherein said layer of antioxidant material has a resistance of $10^{-3}$–$10^{5}\Omega\cdot$cm.

4. An image forming apparatus according to claim 3, wherein said layer of antioxidant material has a resistance of $10^{-3}$–$10^{3}\Omega\cdot$cm.

5. An image forming apparatus according to claim 3, wherein said layer of antioxidant material comprises a resin layer dispersing carbon therein.

6. An image forming apparatus according to claim 3, wherein said layer of antioxidant material comprises a resin layer dispersing graphite therein.

7. An image forming apparatus according to claim 3, wherein said layer of antioxidant material comprises a ceramic coating.

* * * * *